US005373143A

United States Patent [19]

Pfaffmann

[11] Patent Number: 5,373,143

[45] Date of Patent: Dec. 13, 1994

[54] APPARATUS AND METHOD OF MEASURING TEMPERATURE

[75] Inventor: George D. Pfaffmann, Farmington, Mich.

[73] Assignee: Tocco, Inc., Boaz, Ala.

[21] Appl. No.: 85,924

[22] Filed: Jul. 6, 1993

Related U.S. Application Data

[62] Division of Ser. No. 768,026, Sep. 30, 1991, Pat. No. 5,250,776.

[51] Int. Cl.[5] ..... H05B 6/10

[52] U.S. Cl. ..... 219/637; 219/635; 219/639; 266/129; 148/573

[58] Field of Search ..... 219/634, 602, 605–608, 219/626, 627, 635, 637, 643, 660, 663–665, 667; 148/509, 567, 572, 573, 129; 266/127, 129

[56] References Cited

U.S. PATENT DOCUMENTS

| | | | |
|---|---|---|---|
| 4,059,795 | 11/1977 | Mordwinkin | 324/233 |
| 4,230,987 | 10/1980 | Mordwinkin | 324/233 |
| 4,427,463 | 1/1984 | Spies | 148/129 |
| 4,501,942 | 2/1985 | Lewis | 219/10.43 |
| 4,618,125 | 10/1986 | Blazer | 266/90 |
| 4,625,090 | 11/1986 | Pfaffmann et al. | 219/635 |
| 4,634,462 | 1/1987 | Fish et al. | 65/158 |
| 4,673,879 | 6/1987 | Harris et al. | 324/240 |
| 4,675,057 | 6/1987 | Pfaffmann et al. | 148/129 |
| 4,728,761 | 3/1988 | Mucha et al. | 219/10.43 |
| 4,816,633 | 3/1989 | Mucha et al. | 219/635 |
| 4,845,328 | 7/1989 | Storm et al. | 219/10.59 |
| 4,855,556 | 8/1989 | Mucha et al. | 219/105.9 |
| 4,897,518 | 1/1990 | Mucha et al. | 219/10.41 |
| 5,250,776 | 10/1993 | Pfaffmann | 219/635 |

OTHER PUBLICATIONS

"New Induction QC Method Uses Eddy Current Principle", Heat Treating/Nov. 1986, by George Mordwinkin, Arthur L. Vaughn and Peter Hassell, pp. 34–38.

"New Induction Heating Quality Control Tool-Loadanalyzer", Industrial Heating, Journal of Thermal Technology, Dec., 1986, by Peter A. Hassell, George Mordwinkin.

*Primary Examiner*—Bruce A. Reynolds
*Assistant Examiner*—Tu Hoang
*Attorney, Agent, or Firm*—Vickers, Daniels & Young

[57] ABSTRACT

A method and apparatus for measuring the temperature and heating rate of a workpiece during the induction heating cycle by inducing and detecting a plurality of eddy current pulses at varying frequencies during a short power interruption to the induction coil and correlating the pulses to generate a workpiece profile which is compared to a reference profile to determine whether to reject the inductively heated workpiece.

51 Claims, 3 Drawing Sheets

APPARATUS AND METHOD OF MEASURING TEMPERATURE

This is a division of application Ser. No. 768,026 filed Sep. 30, 1991 now U.S. Pat. No. 5,250,776.

The present invention relates to the art of induction heating and more particularly to an apparatus and method of measuring the average or instant temperature profile of a workpiece, including the axial and/or radial workpiece profile, as it is being heated. This concept can be applied to many different types or heating and is especially useful for temperature analysis of inductively heated materials. The present invention also relates to the method of determining the energy level in a material during induction heating by monitoring the temperature of the material. When a material is heated, its electrical and magnetic characteristics vary according to the temperature and/or temperature profile (gradient) at any given depth on the workpiece. This phenomenon of electrical and magnetic changes can be monitored by inducing an eddy current into the material and correlating the output signal to a known standard correlation to the average and/or instant temperature of the material. Eddy current detectors have been known for some time, but have not gained wide acceptance in industry. In accordance with the invention, the method involves eddy current measurements during the actual heating process to give a real time readout of workpiece temperature and/or temperature profile by correlating the eddy current reflection to known parameters indicative of temperature.

INCORPORATION BY REFERENCE

Mordwinkin U.S. Pat. No. 4,059,795 and Mordwinkin U.S. Pat. No. 4,230,987 are incorporated by reference as background information regarding eddy current detection devices. The two references are incorporated as the present preferred embodiments for performing the inventive method and apparatus of the present disclosure. Also incorporated by reference are two articles, Heat Treating, November 1986, pages 34–38, entitled "New Induction QC Method Using Eddy Current Principle" by George Mordwinkin, Authur L. Vaughan and Peter A. Hassell and Industrial Heating, December 1986, pages 17–20, entitled "Loadmonitoring-Another Dimension for Induction Heating" by Peter A. Hassell and George Mordwinkin. These two articles report several common uses for eddy current detection.

The concept of using an eddy current detector to scan a camshaft is disclosed in Balzer U.S. Pat. No. 4,618,125 and Mucha et al U.S. Pat. No. 4,728,761. These two patents are incorporated by reference as containing information for the use of eddy current sensors and analyzers to determine the metallurgical characteristics of a previously inductively heated camshaft.

Eddy current detection during a cooling cycle is disclosed in Spies U.S. Pat. No. 4,427,463. Pfaffmann U.S. Pat. No. 4,675,057 illustrates a method to monitor and control the cooling cycle of a previously inductively heated workpiece. Pfaffmann together with Spies are incorporated by reference for the purpose of illustrating the current state of art of non-destructive testing by eddy current technology of inductively heated materials.

Signature analysis of the heating cycle of an inductively heated system is disclosed in Mucha U.S. Pat. No. 4,897,518. Mucha illustrates the method of measuring the energy across an induction heating coil and correlating the measurements to the amount of energy being transferred to the inductively heated workpiece to create a signature analysis of the inductively heated workpiece.

BACKGROUND OF INVENTION

The present invention relates to a method and apparatus of monitoring the temperature and/or temperature profile of a material during heating and it will be describe with particular reference thereto; however, it will become appreciated that the invention has broader aspects in ascertaining the energy input into the material and the effects of different rates of heating the material with respect to the materials metallurgical properties.

For many years, there has been a demand for controlling heating systems by a variety of non-destructive sensors which could be interfaced with microprocessors to control and/or monitor the heating process and/or determine whether the workpiece has been inadequately heated or otherwise thermally processed and therefore is defective. One method has been to insert thermocouples into the material to measure the thermal change in the material during heating. This method has proven to be impractical for industrial application and is limited to laboratory testing. Thermocouples are typically imbedded into the material to be tested, thus are usually destroyed or are impractical or impossible to reuse once the material is heated.

A common method presently used in industry for controlling the heating of materials is the use of optical pyrometrics. The pyrometer optically measures the radiant energy from the material surface which in turn can only be converted into the surface temperature of the material. However, the accuracy of a pyrometer is affected by the surface conditions and resultant surface emissivity. Inaccurate readings will occur due to scaling of the material and/or incandescent particles within or on the surface of the material itself. Furthermore, smoke, dust, vapors and other gases caused by the induction heating of the material will also impair the accuracy of determining the radiant energy from the material. Finally, the optical pyrometer is limited to only estimating the surface temperature of the material and cannot accurately measure the internal temperatures within the heated material.

There have been, so far, relatively few successful control schemes to control the heating cycle for mass production heating systems. As disclosed in Balzer U.S. Pat. No. 4,618,125 and Mucha et al U.S. Pat. No. 4,728,761, it is possible to use eddy current analysis to determine the metallurgical characteristics of an object after it has been inductively heated and quench hardened to determine whether to accept or reject the hardened object based on comparisons to a preselected plan or pattern formed by an ideal hardened object. However, Both Balzer and Mucha are limited to post induction heating analysis of hardened objects.

Monitoring the temperature of an inductively heated object during quenching is disclosed in Pfaffmann U.S. Pat. No. 4,675,057. Pfaffmann employs the use of eddy current analysis to monitor and regulate the cooling rate of an object during quench hardening. However, the assignee has found that eddy current analysis is impaired during induction heating. The electromagnetic field produced by the induction heating coil can interfere with the analysis of eddy currents within the inductively heated workpiece. Indeed all prior patents have disclosed eddy current analysis either after the material has been hardened, as disclosed in Mucha, Balzer, and Mordwinkin U.S. Pat. Nos. 4,059,795 and 4,230,987, or during the cooling processes, as disclosed in Pfaffmann U.S. Pat. No. 4,675,057 and Spies U.S. Pat. No. 4,427,463.

Eddy current technology has not been successfully applied to in-process use in conjunction with induction heating. By using eddy current analysis, a non-destructive testing procedure of the workpieces can be continuously analyzed during the heating process to monitor and control the proper rate of heating and preferred maximum heating temperature for the workpiece and compare the data to preselected patterns and/or characteristics of acceptable workpieces. However, because of interference by the induction heating coil real time monitoring of induction heating by eddy current techniques has been unattainable.

In view of the present state of the art, assignee of the present application has been searching for an in-process system for monitoring and controlling the heating rates of workpieces during induction heating without requiring destructive testing of the workpiece.

THE INVENTION

The present invention relates to a method and apparatus for measuring the instant and/or average temperature, temperature profile and heating rate of a workpiece during a heating cycle by employing the use of eddy current analysis. Although the present invention is not limited to use with inductively heated materials, the invention will be specifically described in association with inductively heated materials.

In accordance with the principal feature of the present invention, there is provided a method and apparatus for measuring the average and/or instant temperature and/or temperature profile and heating rate of an inductively heated workpiece, wherein an inductor coil is either normal to or completely or partially surrounds a workpiece and the inductor coil is energized from some power supply during the induction heating cycle. The workpiece within the inductor is inductively heated for hardening then subsequently quench hardened. Other various heat treatments can also be employed on the workpiece such as tempering, stress relieving and/or annealing. During the heating cycle, the power from the power supply is periodically reduced or interrupted for short periods of time to produce a series of quiet periods or periods of reduced energy levels. The length of time of the power interruption or reduced energy to the inductor coil is relatively small so as not to adversely affect the relatively continuous heating rate of the inductively heated workpiece. During the interruption of energy or reduced energy to the induction coil, the eddy current coil is periodically energized by a variable frequency power supply to induce a plurality of eddy currents with differing frequencies within the workpiece. The interruption in the power supply or reduced energy to the inductor coil allows the eddy current analyzer to measure the effects of the eddy current in the inductively heated material without undue magnetic interference generated by the fully energized induction coil. The adverse magnetic interference is produced while the inductor coil is operating due to the current flowing through the coil which creates a magnetic field. This magnetic field can cause interference in the eddy current analyzer which may cause some inaccuracy in the analyzer readings. However, if the current through the inductor coil is temporarily suspended or reduced, the adverse magnetic field from the coil ceases to exist, thus allowing the eddy current analyzer to concisely measure the eddy currents within the workpiece without having to filter out any undue interference produced from the induction coil.

The eddy current coil may or may not be energized every time the power supply to the induction coil is reduced or interrupted. Different workpiece geometrics and/or compositions will affect the regularity at which the workpiece temperature needs to be measured. The eddy current energizer and/or analyzer can be set to induce and/or analyze the eddy current pulses at certain quiet periods during the heating cycle which corresponds to a certain axial position on the workpiece. For more complex workpiece geometrics and/or highly variable workpiece compositions, eddy current analysis at each quiet period may be required.

It has been determined that the eddy current pulses and their reflective responses vary with the temperature of the workpiece. This phenomena is the direct result of the effect of temperature on the electrical and magnetic characteristics of the heated material. Such electrical and magnetic characteristics include the workpiece's position, geometry, mass concentration, temperature, resistivity, permeability or other properties of the metal during heating. The term "heating cycle" means the actual processing during which power is supplied to the inductor coil for the purpose of inductively heating a workpiece that is stationary, intermittently or continuously moved through the induction heating coil. The "heating cycle" includes periods of time when the inductor is not energized or is energized at a reduced energy level. For heating processes other than induction heating, the heating cycle is the time period from which the heating process begins to the time the heat processing of the material is completed.

In accordance with the another feature of the present application, the induced eddy current pulses and their reflective responses reflect complex information regarding the present rate of heating of the heated workpiece during the heating cycle. The eddy current detector measures any one of a number of physical characteristics induced by the eddy current coil such as the induced eddy current, voltage and/or phases of the eddy current pulses and their responses. The information can be collected in a microprocessor and digitized to produce digital information representative of eddy current pulses at preselected times during the heating cycle. This digitized signal can then be used to create a single node and/or a signature or profile which can be indicative of a number of electrical, magnetic, prior and present metallurgical structures, chemistry and/or mechanical characteristics of the heated material during the heating cycle. This profile can then be compared to a reference profile which is a stored signature of an ideal or acceptable heated workpiece. The comparison of the generated profile to the reference profile can be used to determine whether or not the heated workpiece is being heated at the proper rate during the heating cycle. In addition, the generated profile which is created from the heated workpiece can be compared with a reference profile to determine whether the heated workpiece is defective or within acceptable quality control range set forth by the manufacturer.

In accordance with yet another feature of the present invention, the eddy current coil is energized at varying high frequencies corresponding to the preselected time period that the power to the inductor coil is reduced or suspended. The varying of the frequency to the eddy current coil induces eddy current pulses with corresponding frequencies within the heated workpiece. It is known that an induced eddy current at a certain frequency will penetrate a material at some specific depth. The induced eddy current pulses represent information indicative of the present rate of heating of the heated workpiece at different depths during the heating cycle. The information is digitized in a microprocessor to create digital information indicative of eddy current pulses at differing depths with the heated workpiece and at preselected times during the heating cycle. The digitalized sign is transformed into a profile which can be compared with a reference profile to determine whether the heated workpiece is being heated at a proper rate during the heating cycle. The generated profile may also be compared to a reference profile to determine whether the workpiece is defective.

In accordance with still another feature of the present invention, the eddy current coil is energized at a plurality of varying frequencies so as to produce an eddy current sweep. When the eddy current coil is used in association with an induction heating coil, the eddy current sweep of the heated material occurs at the preselected time periods that the power to the inductor coil is reduced or suspended. During the eddy current sweep the eddy current coil frequency is varied incrementally or continuously over some preselected range to induce corresponding eddy current pulse frequencies within the heated workpiece. The preselected range of frequencies used during the eddy current sweep should be such that eddy currents will be produced across the complete radial axis of the heated material. The incremental or continuous changing of the frequencies normally is carried out by varying the frequencies from the lowest frequency in the range to the highest frequency in the range or vice versa. The continuous or incremental varying of the frequencies is not limited to varying from high to low or low to high and can be varied in any desired method. Whatever method of frequency varying is used, the induced eddy current frequencies should be such that the eddy currents are adequately distributed in the radial axis of the heated material. The eddy currents that are generated from the eddy current sweep are recorded to produce an eddy current profile and correlated to instant and/or average temperatures to produce a temperature and/or heating rate profiles representative of the heating rate or temperature of a material at any radial position at some specific axial position. Such generated profiles can then be compared to a reference profile for determination of whether the workpiece is defective.

The primary objective of the present invention is the method of measuring the temperature of an inductively heated workpiece during the heating cycle by periodically inducing and monitoring eddy current pulses into an inductively heated workpiece during a temporary power suspension to the inductor coil to obtain a profile of the actual heating rate.

Still a further object of the present invention is the provision of a method of measuring the temperature, as defined above, which method creates a signature or profile used to accept or reject the inductively heated workpiece.

Yet another object of the present invention is the provision of a method, as defined above, which method measures, during selective quiet periods of the heating cycle, eddy current pulses, having varying frequencies, to generate a profile representative of the heating rate at different depths within the inductively heated workpiece for use in accepting or rejecting the workpiece.

Another object of the present invention is the provision of a method, as defined above, which incrementally or continuously varies the power frequency over a preselected range to produce corresponding frequencies of eddy current pulses within the heated material, such eddy current then being recorded and correlated to create a heating profile and/or a instant and/or average temperature profile for use in accepting or rejecting the workpiece.

Still a further object of the present invention is the provision of a method, as defined above, which method includes the correlation of the workpiece profile to the position of the workpiece thus producing a profile that corresponds to the temperature, depth and axial position of the workpiece and comparing the generated profile to a reference profile for use in rejecting or accepting the workpiece.

Yet a further object of the present invention is the provision of a method, as defined above, which method produces a profile which is indicative of the temperature of the inductively heated workpiece for purposes of increasing or reducing the energy to the induction coil and/or adjusting the time in which the workpiece is in contact with the induction coil for purposes of monitoring the heating of the workpiece to assure that the workpiece obtains the proper temperature during induction heating.

Still a further object of the present invention is the provision of a method, as defined above, which method includes monitoring the temperature-depth profile of the workpiece at any axial position of the workpiece. The method of incorporating the axial position of the workpiece with the temperature depth profile can be accomplished by either moving the eddy current coil along the longitudinal axis of the workpiece or employing a plurality of eddy current coils positioned at different distances to generate a workpiece profile corresponding to the temperature, depth, and axial position. Such profile can be used for purposes of accepting or rejecting the workpiece and/or determining the time and/or position to begin quenching the workpiece.

These and other objects and advantages will become apparent from the following description taken together with the accompanying drawings.

PREFERRED EMBODIMENT

Figure 1:
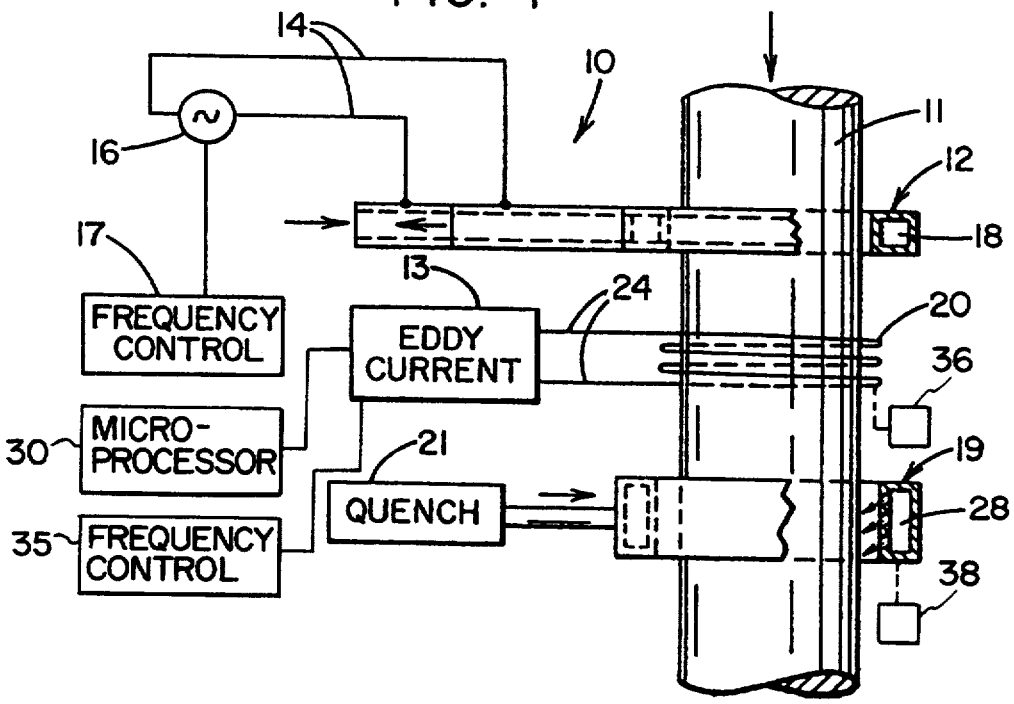
FIG. 1 is a block diagram of the preferred embodiment of the present invention.

Referring now to the drawings wherein the showings are for the purpose of illustrating a preferred embodiment of the invention only and not for the purpose of limiting same, FIG. 1 shows an induction heating system 10 for inductively heating an elongated workpiece 11, composed of a hardenable material. The apparatus 10 comprises an induction coil 12 which generally surrounds a workpiece 11. The coil 12 is formed of an electrically conductive material, such as copper. The coil 12 has leads 14 connected to a conventional power supply 16. An energy control 17 is connected to the power supply 16 to control the degree and duration of power supply 16 during the heating cycle. The coil 12 has an internal passage 18 fluidly connected to a coolant source for maintaining the operating temperature of the coil 12 within control limits. The induction heating system 10 also comprises a quenching ring 19 which surrounds the workpiece 11. The quenching ring 19 contains an internal passage 28 fluidly connected to an air or liquid coolant source 21 for cooling workpiece 11. An eddy current coil 20 is positioned adjacent to workpiece 11. Two leads 24 connect the eddy current coil to an eddy current controller 13. The eddy current controller 13 energizes eddy current coil 20 and detects eddy current within workpiece 11. The eddy current detector can completely or partially encircle workpiece 11 or be normal to the longitudinal axis of workpiece 11. The eddy current controller then transfers the detected signals to a microprocessor 30 for digitizing, processing and collating the signals.

During induction heating, it is critical that workpiece 11 be heated above its austenizing temperature so that during cooling, the austenite within the workpiece will be transformed to martensite. If the proper temperature is not obtained, the workpiece will not properly transform into the proper metallurgical structure to achieve the required degree of hardness thus resulting in an inferior product. As a result, the workpiece temperature must be monitored continuously during the heating cycle to assure that the heating rate within the workpiece is high enough to achieve the proper temperature throughout the workpiece.

Figure 2:
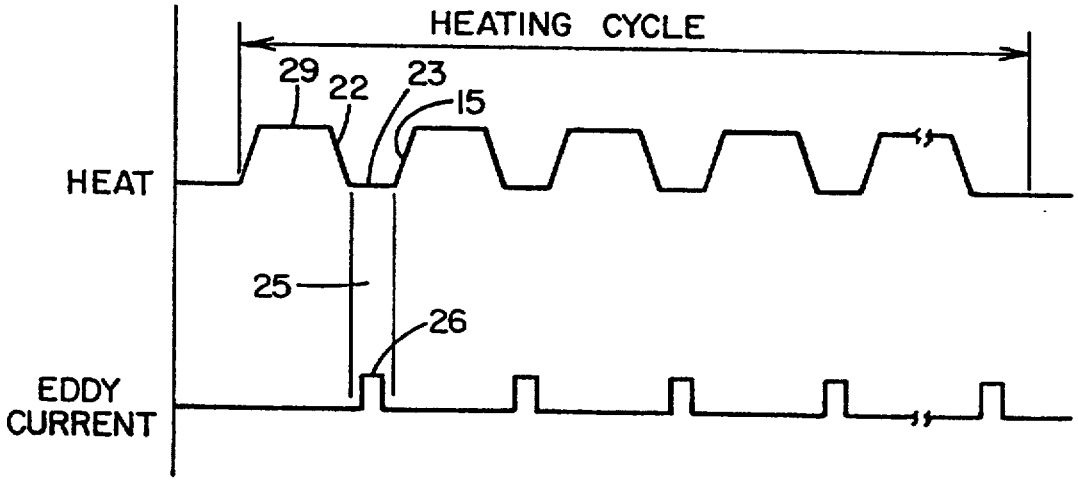
FIG. 2 is a graph illustrating eddy current detection during the heating cycle in accordance with the preferred embodiment illustrated in FIG. 1.

To this end, energy control 17 activates power supply 16 to energize induction coil 12. Periodically during the heating cycle, energy control 17 reduces the power from power supply 16 then fully reactivates power supply 16 which in turn deenergizes and energizes induction coil 12 throughout the heating cycle. FIG. 2 illustrates the deenergizing and energizing of the power supply during the heating cycle. When the power supply 16 is fully activated, the heat input into the workpiece increases over time until the heat input reaches its maximum value, indicated by line 29. Once the heat input reaches its maximum value, it is maintained until the energy control 17 reduces the power from power supply 16. Once power supply 16 is fully or partially deactivated, the heat input decreases, as illustrated by line 22, until there is relatively zero heat input being induced into workpiece 11, as illustrated by line 23. Line 15 illustrates the heat input into the workpiece when the power supply is fully reactivated. Both lines 22 and 15 are slightly sloped to illustrate that the heat input does not instantaneously reach its maximum or minimum value once power supply 16 is fully engaged or fully or partially disengaged, respectively. The graph illustrated in FIG. 2 illustrates a series of quiet periods which correspond to the time period in which power supply 16 is reduced or deactivated and then subsequently reactivated to full power during the heating cycle.

FIG. 2 also illustrates an eddy current window 25 corresponding to each quiet period, wherein eddy current coil 20 can be selectively energized during the quiet periods. The duration of each quiet period is approximately 5 to 20 milliseconds, a time period that is relatively short so as not to adversely affect the induction heating of the workpiece. The preferred time of deactivation or reduced power is about 10 milliseconds. Once energy control 17 deactivates or reduces the power from power supply 16, eddy current controller 13 energizes eddy current coil 20, as illustrated by the eddy current pulse 26 in FIG. 2. When the power to the induction coil is temporarily reduced, the heat input to the workpiece does not instantaneously reduce to the lower power level, as illustrated by line 22. During the short time period that the heat input is decreasing, some current is still flowing through the induction coil which in turn is generating a magnetic field which can cause interference to the eddy current detector. Therefore, it is preferable to energize the eddy current coil after the heat input in the workpiece essentially approaches zero, at which time the induction coil is generating a negligible magnetic field which will not produce any adverse effects to the eddy current detector. The preferable eddy current window is illustrated in FIG. 2.

The eddy current windows illustrated in FIG. 2 illustrate the eddy current coil being energized at every eddy current window. However, the eddy current coil does not have to be energized at every eddy current window. The number of eddy current detections and the time and/or place on the workpiece on which the eddy current detections are made will depend on the composition and shape of the workpiece. Once it is determined how many eddy detection sequences will be induced during the heating cycle of the workpiece based on the shape and composition of the workpiece, a microprocessor 30 or other control device is used to achieve the necessary synchronization between the appropriate quiet period and the eddy current window. Therefore, energy control 17 and eddy current control 13 are connected preferably to a microprocessor 30, whereby the microprocessor signals eddy current controller 13 when energy control 17 deactivates or reduces and subsequently fully re-energizes power supply 16. The microprocessor then determines whether the eddy current coil should be energized at this particular eddy current window and, if so, signals the eddy current controller to energize the eddy current coil.

In response to the signal from the microprocessor, eddy current controller 13 energizes eddy current coil 20 at some frequency controlled by frequency control 35 to induce an eddy current pulse in workpiece 11. The eddy pulse is detected by the eddy current detector and fed back into eddy current controller 13 which is then sent to the microprocessor. The frequency applied to each eddy current pulse is one having a known correlation to the temperature and depth of current penetration in workpiece 11, i.e. surface measurement or measurement at a particular depth.

Figure 3:
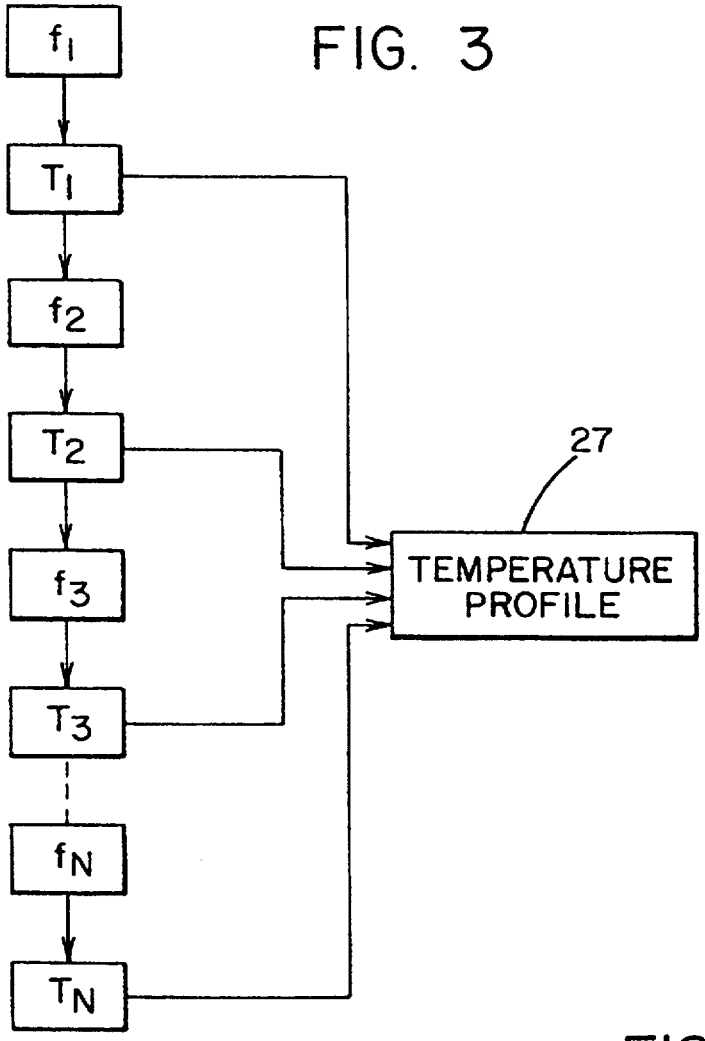
FIG. 3 is a block diagram illustrating the varying of the eddy current frequency to generate a temperature profile corresponding to different depths within the workpiece.
Figure 3A:
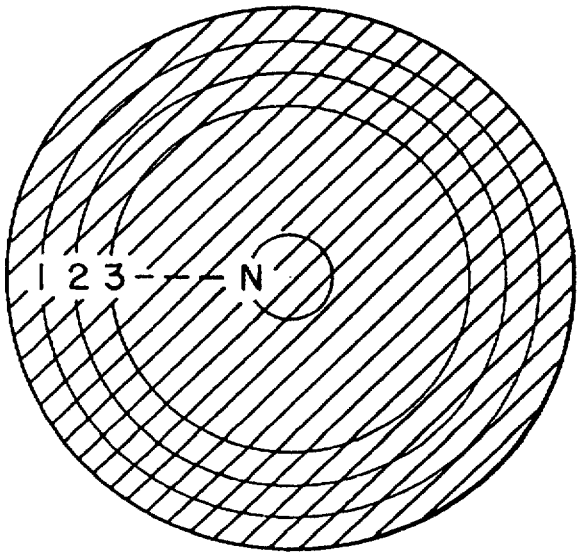
FIG. 3A schematically illustrates a cross-sectional temperature profile for the workpiece.

During the time period that eddy current coil 20 is fully or partially energized, as represented by eddy current window 25, frequency control 35 can vary the frequency in eddy current controller 13, therefore, energizing the eddy current coil at different frequencies which in turn induces eddy current pulses in the workpiece at corresponding frequencies. The eddy current coil can be energized at a plurality of differing frequencies by setting frequency control 35 to continuously and/or incrementally vary the frequency to the eddy current coil. It has been predetermined that different frequencies penetrate into the workpiece at differing depths. The lower the frequency, the farther the eddy current penetrates into the workpiece. One method of determining the temperature and/or heating rate profiles of a heat material is by utilizing an eddy current sweep of the material. Each workpiece requires some range of frequencies to induce eddy currents throughout the radial axis of the workpiece. An eddy current sweep is a continuous and/or incremental varying of the eddy current power supply frequencies to induce eddy currents of corresponding frequencies over the frequency range of a particular workpiece. The varying of the frequencies are preferably varied in ascending or descending order over the frequency range of the workpiece; however, any manner of varying the frequencies of the eddy current power supply can be used. The eddy current sweep in-of-itself produces an eddy current profile representing the eddy currents distributed throughout the radial axis of the workpiece at some particular longitudinal axis position. The depth at which a certain frequency penetrates into a certain workpiece is predetermined and recorded, preferably in a microprocessor 30. The microprocessor transforms the signal received from the eddy current detector into a workpiece temperature at some particular depth within the workpiece. Once the signals are correlated, a temperature profile and/or heating rate profile for the workpiece can be generated which represents a cross-sectional temperature and/or heating rate profile of the workpiece at a particular axial position. FIGS. 3 and 3A illustrate how a cross-sectional temperature profile 27 is generated. $f_1$ to $f_n$ represent the eddy current frequencies induced by eddy current controller 13 and frequency control 35 to produce eddy multiple frequency current pulses in the workpiece. $f_1$ is a higher frequency than $f_2$ and so forth down to the lowest frequency $f_n$. The lower the frequency of the induced eddy current, the farther it penetrates into the depth of the workpiece, as illustrated in FIG. 3A. $T_1$ represents the correlated temperature from the eddy current pulse resulting from $f_1$. Since the eddy current pulses are generated at different depths within the workpiece, a complete cross-sectional temperature profile can be generated. FIGS. 3 and 3A illustrate a generation of a cross-sectional temperature profile wherein $T_1$ is the workpiece surface temperature and $T_n$ is the workpiece core temperature.

Figure 4:
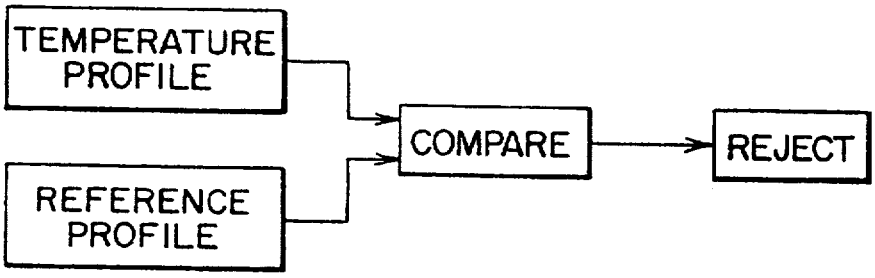
FIG. 4 is a block diagram illustrating an arrangement for comparing a generated temperature profile to a reference profile for determining whether to reject the workpiece.

Once a particular temperature, heating rate and/or eddy current profile is generated, the generated profile can be compared to a reference profile. A reference profile is generally a profile of a workpiece of similar composition and shape that was previously monitored by eddy currents during heating. The similar workpiece was then tested and determined to have the particular metallurgical characteristics specified by the manufacturer. The profile of the tested workpiece is then stored as a reference profile. The reference profile could also be a profile generated by some mathematical model which simulated a particular workpiece to determine what the ideal eddy current signals should be. However the reference profile is created, the profile will usually be stored in microprocessor 30 for comparative analysis with other workpieces. For example, a temperature profile, such as the one illustrated in FIG. 3, is generated and then compared to some reference profile. Microprocessor 30 compares the generated profile to the reference profile and determines whether the generated profile falls within some predetermined deviation for the reference profile, and if not, the microprocessor generates a signal to indicate that the workpiece is defective and should be rejected. The method of comparing profiles and determining whether to reject a particular workpiece is illustrated in FIG. 4.

Figure 5:
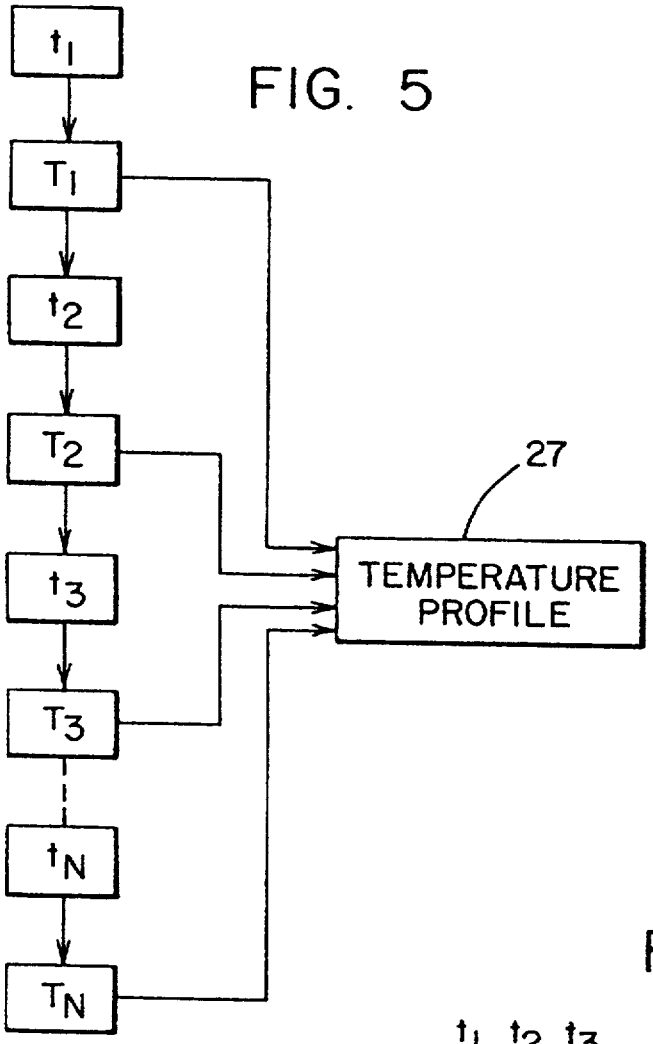
FIG. 5 is a block diagram illustrating the generating of a temperature profile corresponding to the axial position of the workpiece; and, FIG. 5A illustrates the axial position of the workpiece relative to the time during the heating cycle.
Figure 5A:
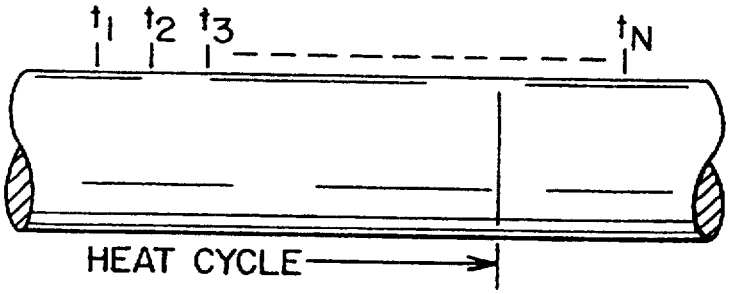

Since workpieces do not always have a uniform shape and/or material composition, the axial position of the workpiece in relation to its cross-sectional temperature and/or heating rate is important. Therefore, FIG. 5 illustrates the correlation of the cross-sectional temperature profile to a particular axial position on the workpiece. As the workpiece moves through the induction coil, the speed at which the workpiece passes the coil is correlated to some time interval $t_1$ to $t_n$, as illustrated in FIG. 5A. The time intervals correspond to some axial position on the workpiece and are stored, preferably in a microprocessor. The time intervals are then correlated to workpiece temperatures to generate temperature profile 27. Preferably, the time intervals are correlated to a cross-sectional temperature, heating rate and/or eddy current profile to generate a profile which relates to the cross-sectional temperature, heating rate and/or eddy current profile of the workpiece at some axial position. The generated profile can then be compared to a reference profile to determine whether the workpiece is within the criteria set by the manufacturer. Furthermore, since the axial position of the workpiece is being recorded, the microprocessor can signal energy control 17 to increase or decrease the power to the induction coil and/or alter the rate at which the workpiece is passed through the induction coil based in the shape and/or composition of the workpiece.

It is also important to monitor the temperature of the workpiece after it has passed through the induction coil. Different rates of cooling the workpiece by the quenching process results in different metallurgical properties of the workpiece. However, the quenching process must begin before the workpiece temperature falls below its critical temperature. Therefore, it is important to monitor the cross-sectional temperature of the workpiece after it has passed through the induction coil so as to commence the quenching process before the workpiece temperature falls below the critical temperature. There are at least two methods to use to monitor the cross-sectional workpiece temperature after it has passed through the induction coil. The preferable method is to use at least two eddy current coils permanently positioned at different distances from the induction coil. The signals from the two coils can then be digitized and processed to determine the cross-sectional temperature of the workpiece prior to being quenched. Alternatively, the eddy current coils can be attached to a device such as that indicated by numeral 36 in FIG. 1 that can move at least one of the eddy current coils along the axial axis of the workpiece. In each method, the microprocessor would then correlate the position of the eddy current coil in relation to the axial position of the workpiece. Once the temperature of the workpiece is correlated relative to its position from the induction coil, the quench ring can be permanently positioned or automatically repositioned by a device such as that indicated by numeral 38 in FIG. 1 to a proper distance from the induction coil so as to begin the quenching process before the workpiece temperature falls below the critical temperature.

Having thus described the invention, it is claimed:

1. A method of measuring the temperature of a workpiece heated by induction heating, said method comprising the steps of:

(a) positioning said workpiece adjacent to an induction heating coil;

(b) energizing said induction heating coil by a power supply for a heating cycle;

(c) positioning said workpiece adjacent at least one eddy current measuring coil, wherein said eddy current measuring coil is energized by a variable high frequency power source;

(d) temporarily reducing the current from said power supply to said induction heating coil during said heating cycle at a preselected time and duration of time to create a series of quiet periods in said cycle;

(e) energizing said power source to said eddy current measuring coil during selected said quiet periods to induce a plurality of eddy current pulses in said workpiece;

(f) measuring at least one of induced current, voltage and phase characteristics of said eddy current pulses to produce a plurality of output signals; and (g) correlating said output signals to respective temperatures of the workpiece.

2. The method of claim 1 wherein said workpiece has an axis and said at least one eddy current measuring coil is moved adjacent to the axis of said workpiece.

3. The method of claim 1 wherein said duration of each of said quiet period is between 5 to 20 milliseconds.

4. An apparatus for measuring the temperature of a workpiece during induction heating of said workpiece comprising induction coil means for inductively heating said workpiece, means for periodically reducing the power to the induction coil means during said heating for a 10 millisecond time period, means for inducing a plurality of multifrequency eddy current pulses in said workpiece during said time period, means for detecting and correlating said pulses to generate a temperature profile corresponding to the temperature of said workpiece in a cross-sectional area at an axial position on said workpiece, and means for comparing said temperature profile to a reference profile to determine whether to reject said workpiece.

5. The method of claim 1 wherein said output signals are correlated to create a temperature profile for said workpiece.

6. The method of claim 5 wherein said temperature profile is compared to a reference profile to determine whether to accept or reject said workpiece.

7. The method of claim 1 where said power source generates a plurality of said eddy current pulses of differing frequencies.

8. The method of claim 7 wherein said eddy current pulses are measured and correlated to respective temperatures of said workpiece at a specific depth within the workpiece.

9. The method of claim 8 wherein said temperatures are transformed into a temperature profile corresponding to a cross-sectional area of said workpiece.

10. The method of claim 9 wherein said temperature profile is compared to a reference profile for purposes of accepting or rejecting said workpiece.

11. The method of claim 10 wherein said workpiece has an axis and said temperature profile is correlated to an axial position on said workpiece.

12. The method of claim 11 wherein said temperature profile is compared to a reference profile to determine whether to reject said workpiece.

13. The method of claim 1 wherein said eddy current measuring coil is energized at all of said quiet periods.

14. The method of claim 5 wherein said output signals are correlated to create an instantaneous temperature profile.

15. The method of claim 5 wherein said output signals are correlated to create an average temperature profile.

16. The method of claim 1 wherein said output signals are correlated to create a heating rate profile for said workpiece.

17. The method of claim 16 wherein said heating rate profile is compared to a reference profile to determine whether to accept or reject said workpiece.

18. The method of claim 17 wherein said workpiece has an axis and said power source generates an eddy current sweep over a frequency range of said workpiece to induce eddy currents radially throughout said workpiece.

19. The method of claim 18 wherein said eddy current sweep is continuously varied over said frequency range.

20. The method of claim 18 wherein said eddy current sweep is incrementally varied over said frequency range.

21. The method of claim 19 wherein said frequency range includes all frequencies that produce said eddy currents at differing depths within said workpiece.

22. The method of claim 20 wherein said frequency range includes all frequencies that produce said eddy currents at different depths within said workpiece.

23. A method of determining the temperature of a workpiece during an induction heating cycle comprising the steps of inductively heating a workpiece having an axis with an induction coil powered by a power supply, periodically reducing the power from said power supply for 5 to 20 millisecond time intervals at predetermined time periods for producing a series of quiet periods during said heating cycle, energizing at least one eddy current coil at varying frequencies during said quiet periods to generate a plurality of eddy current pulses at varying frequencies within said workpiece, measuring and correlating said eddy current pulses to the cross-sectional temperature at an axial position on said workpiece to generate a workpiece temperature profile, and comparing said temperature profile to a reference profile to determine whether to reject the workpiece.

24. A method of claim 23 wherein said at least one eddy current coil is moved along said axis of the workpiece.

25. A method of claim 24 wherein said at least one eddy current coil generates a plurality of eddy current pulses at varying frequencies within said workpiece at different positions along the longitudinal axis of said workpiece.

26. A method of claim 25 including the further step of quenching said workpiece by passing said workpiece through a quench ring and wherein said pulses are correlated into cross-sectional workpiece temperatures corresponding to a certain longitudinal workpiece position at a period of time after said workpiece has passed through said induction coil but before passing through said quench ring.

27. A method of claim 26 wherein the cross-sectional temperature of said workpiece is monitored after being inductively heated to position said quench ring at a predetermined distance from said induction coil to begin said quenching before said workpiece falls below a predetermined temperature.

28. A method of claim 27 wherein said quench ring is adjustably positioned along said axis of said workpiece.

29. A method of claim 25 wherein eddy current pulses in said workpiece result from a continuous eddy current sweep.

30. A method of claim 25 wherein eddy current pulses in said workpiece result from an incremental eddy current sweep.

31. An apparatus for measuring the temperature of an inductively heated workpiece, said apparatus comprising:

(a) means for inductively heating said workpiece;
(b) means for positioning at least one eddy current coil adjacent to said workpiece;
(c) suspending means to cease said induction heating means at preselected time and duration to produce a series of quiet periods;
(d) means for selectively energizing said eddy current coil to produce eddy current pulses during said quiet periods;
(e) means connected to said eddy current coil for measuring said eddy current pulses in said workpiece to produce a plurality of output signals; and
(f) means for correlating said output signals to a measured temperature of said workpiece.

32. An apparatus as defined in claim 31 including a means for storing and digitizing said output signals in a computer or microprocessor to produce a temperature profile of said workpiece.

33. An apparatus as defined in claim 32 including a means for comparing said temperature profile to a reference profile to determine whether to reject said workpiece.

34. An apparatus as defined in claim 31 including a means for activating said suspending means at preselected time intervals and for a period between 5 to 20 milliseconds.

35. An apparatus as defined in claim 31 including a means for energizing said eddy current coil at variable high frequencies to produce a plurality of variable high frequency eddy current pulses.

36. An apparatus as defined in claim 35 including a means for detecting said eddy current pulses to produce output signals.

37. An apparatus as defined in claim 36 including a means of collating, digitizing and correlating said output signals to generate a temperature profile corresponding to the temperature in a cross-sectional area of said workpiece.

38. An apparatus as defined in claim 37 including a means for comparing said temperature profile to a reference profile for the purpose of accepting or rejecting said workpiece.

39. An apparatus as defined in claim 37 including a means of generating a temperature profile which corresponds to said temperature in a cross-sectional area at an axial position on said workpiece.

40. An apparatus as defined in claim 39 including a means for comparing said temperature profile to a reference profile to determine whether to accept or reject said workpiece.

41. An apparatus as defined in claim 31 including a means for energizing said eddy current coil during every one of said quiet periods.

42. An apparatus as defined in claim 36 including a means for storing and digitizing said output signals in a computer or microprocessor to produce a heating rate profile of said workpiece.

43. An apparatus as defined in claim 42 including a means for comparing said profile to a reference profile to determine whether to reject said workpiece.

44. An apparatus as defined in claim 35 including a means for performing an eddy current sweep of said workpiece to produce said eddy current pulses radially across said workpiece.

45. An apparatus as defined in claim 36 including a means of collating, digitizing and correlating said output signals to generate a heating rate profile corresponding to the heating rate in a cross-sectional area of said workpiece.

46. An apparatus as defined in claim 45 including a means for comparing said heating rate profile to a reference profile to determine whether to accept or reject said workpiece.

47. An apparatus as defined in claim 44 wherein said output signals produced from said eddy current sweep are transformed into an eddy current profile to be compared to a reference profile to determine whether to reject said workpiece.

48. An apparatus as defined in claim 44 including a means for correlating said pulses to said axial position of the workpiece.

49. An apparatus as defined in claim 48 wherein said workpiece has an axis and including means for moving at least one eddy current coil along said axis of said workpiece.

50. An apparatus as defined in claim 48 including a quench ring for quenching said workpiece and means for adjusting the distance between the induction coil and said quench ring based upon said temperature profile.

51. An apparatus as defined in claim 50 including a means for adjustably moving said quench ring from said induction coil based of said temperature profile.

* * * * *